US012564254B2

(12) United States Patent
Sumerville et al.

(10) Patent No.: US 12,564,254 B2
(45) Date of Patent: Mar. 3, 2026

(54) APPARATUS FOR HAIR COOLING AND DEHUMIDIFICATION

(71) Applicant: Tight & Right Hair Revolution, Inc., Baltimore, MD (US)

(72) Inventors: Larry Maurice Sumerville, Baltimore, MD (US); Tumajah Vernet Sumerville, Baltimore, MD (US)

( * ) Notice: Subject to any disclaimer, the term of this patent is extended or adjusted under 35 U.S.C. 154(b) by 827 days.

(21) Appl. No.: 17/878,125

(22) Filed: Aug. 1, 2022

(65) Prior Publication Data

US 2023/0090816 A1 Mar. 23, 2023

Related U.S. Application Data

(63) Continuation-in-part of application No. 16/429,316, filed on Jun. 3, 2019, now Pat. No. 11,399,612, which is a continuation-in-part of application No. 15/593,416, filed on May 12, 2017, now Pat. No. 10,306,966.

(60) Provisional application No. 62/495,586, filed on May 14, 2016.

(51) Int. Cl.
*A45D 20/18* (2006.01)
*A45D 20/24* (2006.01)
(Continued)

(52) U.S. Cl.
CPC ..... *A45D 20/18* (2013.01); *A45D 20/24* (2013.01); *A45D 20/26* (2013.01); *A45D 20/34* (2013.01);
(Continued)

(58) Field of Classification Search
CPC ..... A45D 20/18; A45D 20/24; A45D 20/26; A45D 20/34; A45D 20/20; F24F 3/1411;
(Continued)

(56) References Cited

U.S. PATENT DOCUMENTS 3,972,126 A * 8/1976 DeMuro ..... A45D 20/34 34/100
3,992,785 A * 11/1976 McCachren ..... A45D 20/24 34/99
(Continued)

FOREIGN PATENT DOCUMENTS

AT 510926 A1 * 7/2012
CN 109077425 A * 12/2018 ..... A45D 20/22
(Continued)

OTHER PUBLICATIONS

Translation, KR-20200054445-A (Year: 2020).*
(Continued)

*Primary Examiner* — Jessica Yuen
(74) *Attorney, Agent, or Firm* — Law Offices of John J. Skinner, Jr.; John J. Skinner, Jr.

(57) ABSTRACT

A hair cooling and dehumidification apparatus is disclosed. The apparatus comprises a wearable headgear/two-part fitness cap having an inner cavity for receiving a portion of a user's head. The wearable headgear comprises a top/outer insert and a bottom/inner insert. Both inserts comprise a plurality of offsets to maintain an air space gap between them. A pouch holder is provided to secure a desiccant pouch and attached to the top insert to absorb the water vapour from user's hair. The apparatus further comprises a thermo-electric cooling system having a thermoelectric cooler. A small heat sink is attached to a cold side of the thermoelectric cooler whereas a large heat sink is attached to a hot side. Further, a blower unit is attached to the small heat sink which is connected to the cold side of the thermoelectric cooling plate, to circulate the ambient air within the housing over the cold heat sink, to cool the incoming air circulating within the housing, thereby providing cooling and dehumidification of user's hair.

19 Claims, 20 Drawing Sheets

(51) Int. Cl.

| | |
|---|---|
| ***A45D 20/26*** | (2006.01) |
| ***A45D 20/34*** | (2006.01) |
| ***F24F 3/14*** | (2006.01) |
| ***F24F 5/00*** | (2006.01) |
| ***F25B 21/02*** | (2006.01) |

(52) U.S. Cl.
CPC ..... *F24F 3/1411* (2013.01); *F24F 5/0014* (2013.01); *F25B 21/02* (2013.01); *F24F 2221/38* (2013.01)

(58) Field of Classification Search
CPC ..... F24F 5/0014; F24F 2221/38; F24F 7/06; F25B 21/02; F25B 2321/023; F25B 2321/0251; A45F 3/005; A45F 3/04; A45F 5/021
See application file for complete search history.

(56) References Cited

U.S. PATENT DOCUMENTS

| | | | | |
|---|---|---|---|---|
| 4,766,614 | A * | 8/1988 | Cantwell | A42B 3/281 2/419 |
| 9,381,106 | B2 * | 7/2016 | Gilmer | A61F 5/05883 |

FOREIGN PATENT DOCUMENTS

| | | | | |
|---|---|---|---|---|
| CN | 111743283 | A * | 10/2020 | A45D 20/28 |
| ES | 414879 | A1 * | 5/1976 | A45D 20/24 |
| JP | 2014023604 | A * | 2/2014 | |
| KR | 200209734 | A * | 1/2001 | |
| KR | 20020011308 | A * | 2/2002 | A41D 13/0025 |
| KR | 101418363 | B1 * | 7/2014 | A45D 20/24 |
| KR | 101824533 | B1 * | 2/2018 | A45D 20/24 |
| KR | 20200054445 | A * | 5/2020 | H04L 67/125 |

OTHER PUBLICATIONS

Translation, CN-109077425-A (Year: 2018).*
Translation, ES-414879-A1 (Year: 1976).*
Translation, CN-111743283-A (Year: 2020).*
Translation, KR-101824533-B1 (Year: 2018).*
Translation, KR-101418363-B1 (Year: 2014).*
Translation, KR-200209734-A (Year: 2001).*
Translation, JP-2014023604-A (Year: 2014).*
Translation, KR-20020011308-A (Year: 2002).*
Translation, AT-510926-A1 (Year: 2012).*

* cited by examiner

APPARATUS FOR HAIR COOLING AND DEHUMIDIFICATION

CROSS-REFERENCE TO RELATED APPLICATIONS

This non-provisional patent application is a continuation-in-part application under 35 U.S.C. § 120 of U.S. patent application Ser. No. 16/429,316 for "Apparatus for Hair Cooling and Dehumidification", filed Jun. 3, 2019, and which claims the benefit under 35 U.S.C. § 120 of U.S. patent application Ser. No. 15/593,416 for "Apparatus for Hair Cooling and Dehumidification", filed May 12, 2017, and which claims the benefit under 35 U.S.C. § 119(e) of U.S. Provisional Patent Application Ser. No. 62/495,586 for "Hair Cooling and Dehumidification Apparatus", filed May 14, 2016, the disclosure of each of which is incorporated herein by reference.

BACKGROUND OF THE INVENTION

A. Technical Field

The present invention relates generally to a hair care apparatus. More particularly, the invention relates to an apparatus for cooling and dehumidifying the hair of a user.

B. Description of Related Art

Hair care, in general, refers to practices and treatments that maintain overall health and hygiene of the hair from the scalp of an individual. Well-maintained hair is integral to the general hygiene and confidence of the individual in a social setting. Salons and hair wellness centers work to provide healthy and aesthetically pleasing hairstyles. Typically, stylists use chemical hair straightening products such as a relaxer to straighten curly hair. The usage of chemical products is harmful to users if it contacts the skin. An apparatus, which allows a user to preserve the user hairstyle without the application of chemical products, is required. Additionally, their use results in the formation of brittle and easily damaged hair. Over the years, there has been a trend in the hair care industry, especially among the African American community, of moving away from chemical hair straightening products and embracing natural hair. Consequently, the trend has led to a decline in the sale of chemical products. Both women and men sporting long hair prefer natural hair because it allows them the versatility of having curly hair one day and having their hair straightened the next using a curling iron, flat iron, hot comb, or blow dryer. However, women who wish to keep their hair straightened for extended periods find it challenging to do so because of hot and humid conditions, steam from baths or showers, activities that require them to sweat, etc. Unlike Caucasian women, African American and biracial women do not wash their hair every day because their hair does not become oily in the same fashion as Caucasian women. As a result, it is highly desirable for an African-American woman who has straightened hair, to prevent their hair from getting wet until the time comes for them to wash it.

Currently, existing solutions do not allow women to keep their stylized hair free from moisture while showering, exercising, or participating in any other activity. This translates to a lack of exercise, cool showers with a shower cap, comfortless nights, and/or no vigorous activities. Women with straightened hair have to visit a salon to professionally straighten their hair or take time to do it themselves periodically, which costs both money and effort. After having hair straightened without using chemicals, women must take many precautions to preserve straightened hair. Keeping natural hair straight involves staying out of humid environments and avoiding any activity that causes head sweat. This often keeps women from exercising, enjoying long hot showers/baths or even engaging in vigorous passionate sexual experiences. The only other options available to women include, for example, wearing a wig, wearing short hair dues, wearing sports caps, or wearing bands that draw moisture from the scalp but by that time hair roots are already compromised. Women would be glad to embrace an alternative that gives them the freedom to keep their hair the way they want it and still do what they want to do. An apparatus, which absorbs moisture or perspiration from the hair to preserve the opted hairstyle of an individual without affecting his/her lifestyle, is required. Such an apparatus provides the individual with the freedom to engage in vigorous activities without affecting their hairstyle.

Hence, there is a need for an apparatus, which allows a user to preserve hairstyle without the application of chemical products. Furthermore, there is a need for an apparatus, which absorbs moisture or perspiration from the hair to preserve the opted hairstyle of an individual without affecting the user's lifestyle.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

In an embodiment, a hair cooling apparatus for cooling and absorbing the moisture of hair of an individual or a user is disclosed. The apparatus comprises a wearable headgear and a portable carrier. In one embodiment, the wearable headgear is configured to provide cooling for the user's hair to prevent moisture. The wearable headgear includes a flexible hose within an interior cavity. The apparatus further comprises a blower unit securely positioned within the portable carrier. In one embodiment, the blower unit is a fan. The blower unit is securely connected to an open end of the flexible hose of the wearable headgear via a connector. In one embodiment, the blower unit is configured to supply air within the interior cavity of the wearable headgear via the flexible hose, thereby providing cooling to the user's hair and protecting from moisture or perspiration for preserving an opted hairstyle of the user without affecting the lifestyle. The blower unit supplies airflow and delivers at high pressure within the interior cavity via the flexible hose. In one embodiment, the blower unit is powered using one or more power sources or batteries. In another embodiment, the blower unit is further configured to connect to a power supply using an insulating cable. The apparatus is further configured to use while running and/or actively engaging in other physical activities.

In one embodiment, the portable carrier could be a backpack. The portable carrier is simple, lightweight, versatile, comfortable to wear, compact and decorative in appearance. The portable carrier could be used during running or actively engaging in other physical activities. In one embodiment, one or more power sources or batteries are securely and removably positioned within the portable carrier. The one or more batteries are configured to provide power to the blower unit. In one embodiment, the batteries could be, but not limited to, lithium-ion batteries and rechargeable batteries.

In one embodiment, a wearable headgear or a two-part fitness cap comprises a thermo-electric cooling system. In one embodiment, the thermo-electric cooling system comprises a thermoelectric cooler or thermoelectric cooling plate. The thermoelectric cooling plate has a cold side and a hot side. In one embodiment, thermo-electric cooling system further comprises a small heat sink and a large heat sink. The small heat sink is connected to the cold side of the thermoelectric cooling plate. The large heat sink is connected to the hot side of the thermoelectric cooling plate.

In one embodiment, the thermoelectric cooling system further comprises a blower unit. In one embodiment, the blower unit is attached above the small heat sink which is connected to the cold side of the thermoelectric cooling plate, to circulate the ambient air within the housing over the cold heat sink, to cool the incoming air circulating within the housing, thereby providing cooling and dehumidification of user's hair. In one embodiment, the blower unit is configured to circulate the ambient air inside the small heat sink to remove an excess heat generated by the thermoelectric cooling plate and the excess heat is transferred to the large heat sink to exhaust the excess heat, thereby providing cooling to the user's hair and protecting from moisture or perspiration for preserving an opted hairstyle of the user.

In one embodiment, a housing encloses the thermoelectric cooling system and a plurality of internal components. In one embodiment, the housing comprises an outer cover and an inner cover. In one embodiment, the large heat sink of the thermoelectric cooling system stays external to the housing at the outer cover as it is an exhaust for the heat generated by the thermoelectric cooling plate. In one embodiment, the small heat sink gives AC to the inner side of the housing.

The wearable headgear includes an interior cavity for receiving a portion of the individual's head. In one embodiment, the wearable headgear comprises a top or outer insert and a bottom or inner insert. In one embodiment, the top insert and the bottom insert are snapped off on top of each other that forms an inner cavity. In one embodiment, the top insert and the bottom insert are placed together to provide an air space gap between them. In one embodiment, the top and bottom insert are snapped off using some glue to firmly adhere and permanently fix with one another.

In one embodiment, the wearable headgear further comprises an air hose connected at a back portion of the wearable headgear in order to create a positive airflow between the top and bottom inserts. The top insert comprises a first plurality of offsets at its underside. The bottom insert comprises a second plurality of offsets at its outer side. In one embodiment, the offsets are configured to maintain the air pressure in an air space gap. In one embodiment, the bottom insert further comprises a plurality of air jet holes or air holes at its underside. In one embodiment, the air jet holes are configured to pass the air via the air hose to cool and dehumidify the user's hair.

In one embodiment, the wearable headgear further comprises a pouch holder configured to hold a desiccant pouch. In one embodiment, the wearable headgear further comprises one or more adjustable openings positioned at its rear portion or top portion configured to allow the user's hair to extend through the adjustable opening for preserving opted hairstyle.

In one embodiment, the flexible hose is securely positioned within the interior cavity of the wearable headgear. The flexible hose is configured to circulate air within the interior cavity via a plurality of openings or ducts. The flexible hose further includes an open end and a closed end. The open end of the flexible hose is securely connected to the blower unit via the connector and the closed end increases the pressure of the air to force out via the plurality of openings or ducts of the flexible hose within the interior cavity of the wearable headgear. In one embodiment, the flexible hose is removably connected to the blower unit via the connector. The flexible hose is positioned within the internal cavity in, but not limited to, a zigzag pattern to effectively and uniformly provide cooling for the user's hair throughout the wearable headgear. In one embodiment, the flexible hose is woven into the wearable headgear. In one embodiment, the flexible hose is made of a material includes, but not limited to, plastic, a rubber, and an elastic material.

In one embodiment, the connector is removably connected to the open end of the flexible hose. In one embodiment, the connector includes a push-button. The push-button is configured to quickly and simply connect and disconnect the flexible hose from the blower unit, thereby reducing the amount of time necessary to connect and disconnect the flexible hose to the blower unit. The push-button allows for a snap-on and snap-off type connection. In one embodiment, the wearable headgear further comprises an extended portion on both sides. The wearable headgear further comprises a moisture absorbing material. The moisture absorbing material is shaped and curved to fit around an edge and ear portions of the wearable headgear. The moisture absorbing material is configured to effectively absorb the sweat around the user's brow, ear portions, and the neck portion. In one embodiment, the moisture absorbing material is a sweatband.

In one embodiment, the apparatus further includes a filter. The filter is securely and removably positioned at the blower unit within the portable carrier. The filter is configured to purify the air for providing freshness to the hair. In one embodiment, the filter is a scented, de-odorizing and air cleaning filter and provided with a desiccant to prevent humid air from entering into the flexible hose. In one embodiment, the wearable headgear further comprises a desiccant for drying the user's hair to keep fresh.

In one embodiment, the wearable headgear further includes at least one hole on, but not limited to, a top portion. In one embodiment, the wearable headgear is further configured to enable a user to pull the hair from the hole for securing the hair in the form of a ponytail. The user's hairstyle, for example, a ponytail, is maintained firmly in place even the user moving into the wind or engaging in riding, running, or other physical activities which prevent their hair from getting sweaty and moisture.

In one embodiment, the wearable headgear further includes at least one adjustable opening on top portion. The adjustable opening is provided on, but not limited to, a top portion of the wearable headgear. In one embodiment, the wearable headgear is further configured to enable a user to pull the hair from the adjustable opening for securing the hair in the form of a ponytail. The user's hairstyle, for example, a ponytail, is maintained firmly in place even the user is moving into the wind or engaging in riding, running, or other physical activities which prevent their hair from getting sweaty and moisture.

In another embodiment, the wearable headgear is configured to enable a user to use while showering or bathing. In one embodiment, the wearable headgear is designed to use for various hair styles such as, but not limited to, ponytails and various bridal hair styles. The wearable headgear is also suitable to use while the user is sleeping and showering. The adjustable opening is increased or personalized as per the user's need. In one embodiment, the wearable headgear for sleeping/showering/bathing includes an air intake opening at the top portion instead from the back portion. The user could simply and quickly wear the wearable headgear while providing comfort to the user. In another embodiment, the open end of the flexible hose is pulled out from a top portion of the wearable headgear. Further, the open end is removably connected to the blower unit via the connector. The wearable headgear is used to prevent the hair of the user from getting wet or moisture while showering, bathing or swimming.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1:
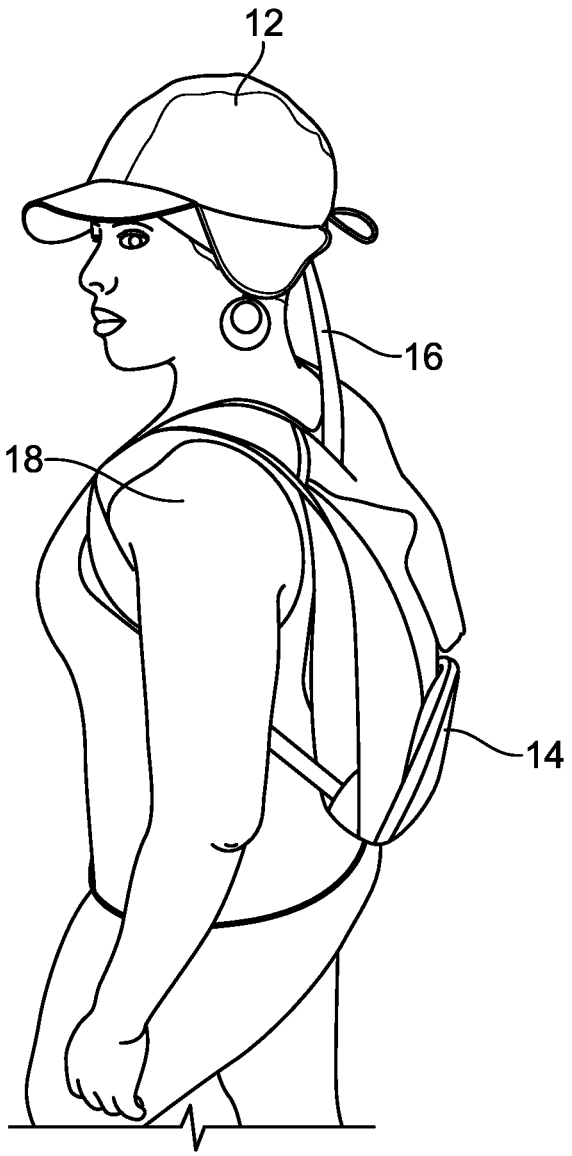
FIG. 1 exemplarily illustrates a side perspective view of a hair cooling and dehumidification apparatus according to an embodiment of the present invention.

Referring to FIG. 1, a hair cooling and dehumidification apparatus 10 for cooling and absorbing the moisture of hair of an individual or a user 18 is disclosed. The apparatus 10 comprises a wearable headgear 12 and a portable carrier 14. In one embodiment, the wearable headgear 12 is configured to provide cooling for the user's hair to prevent moisture. The wearable headgear 12 includes a flexible hose 22 (shown in FIG. 2) within an interior cavity 20 (shown in FIG. 2). The apparatus 10 further comprises a blower unit securely positioned within the portable carrier 14. In one embodiment, the blower unit is a fan. The blower unit is securely connected to an open end of the flexible hose 22 of the wearable headgear 12 via a connector 16. In one embodiment, the blower unit is configured to supply air within the interior cavity 20 of the wearable headgear 12 via the flexible hose 22, thereby providing cooling to the user's hair and protecting from moisture or perspiration for preserving an opted hairstyle of the user without affecting the lifestyle. The blower unit supplies airflow and delivers at high pressure within the interior cavity 20 via the flexible hose 22. In one embodiment, the blower unit is powered using one or more power sources or batteries. In another embodiment, the blower unit is further configured to connect to a power supply using an insulating cable. The apparatus 10 is further configured to use while running and/or actively engaging in other physical activities.

In one embodiment, the portable carrier 14 could be a backpack. The portable carrier 14 is simple, lightweight, versatile, comfortable to wear, compact and decorative in appearance. The portable carrier 14 could be used during running or actively engaging in other physical activities. In one embodiment, one or more power sources or batteries are securely and removably positioned within the portable carrier 14. The one or more batteries are configured to provide power to the blower unit. In one embodiment, the batteries could be, but not limited to, lithium-ion batteries and rechargeable batteries.

Figure 2:
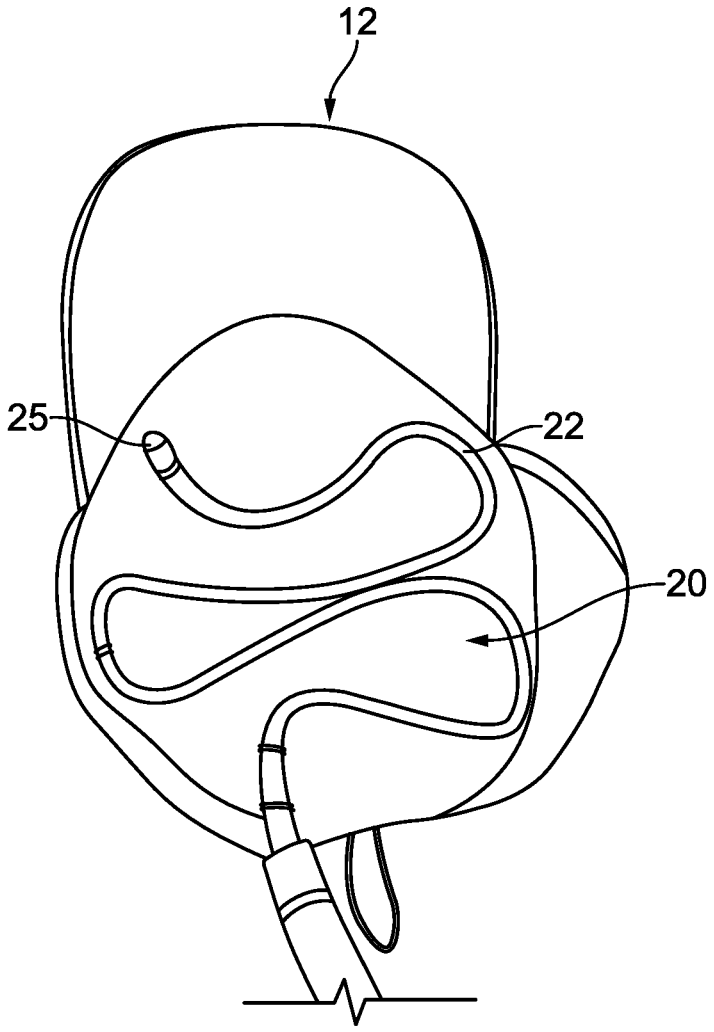
FIG. 2 exemplarily illustrates a bottom view of a wearable headgear of the hair cooling and dehumidification apparatus according to one embodiment of the present invention.

Referring to FIG. 2, the wearable headgear 12 includes an interior cavity 20 for receiving a portion of the individual's head is disclosed. In one embodiment, a flexible hose 22 is securely positioned within the interior cavity 20 of the wearable headgear 12. The flexible hose 22 is configured to circulate air within the interior cavity 20 via a plurality of openings or ducts. The flexible hose 22 further includes an open end 24 (shown in FIG. 3) and a closed end 25. The open end of the flexible hose 22 is securely connected to the blower unit via the connector 16 (shown in FIG. 1) and the closed end increases the pressure of the air to force out via the plurality of openings or ducts of the flexible hose within the interior cavity 20 of the wearable headgear 12. In one embodiment, the flexible hose 22 is removably connected to the blower unit via the connector 16. The flexible hose 22 is positioned within the internal cavity 20 in, but not limited to, a zigzag pattern to effectively and uniformly provide cooling for the user's hair throughout the wearable headgear 12. In one embodiment, the flexible hose 22 is woven into the wearable headgear 12. In one embodiment, the flexible hose 22 is made of a material includes, but not limited to, plastic, a rubber, and an elastic material.

Figure 3:
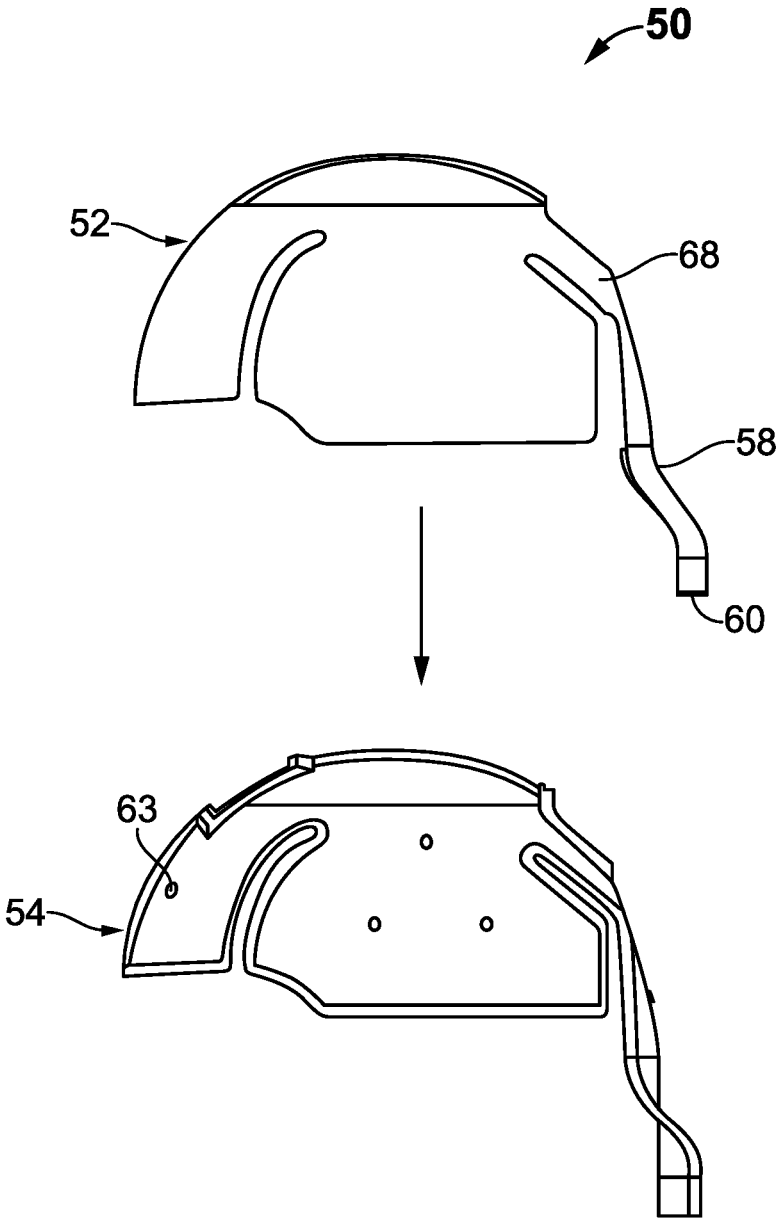
FIG. 3 exemplarily illustrates an exploded view of a wearable headgear or two-part fitness cap according to one embodiment of the present invention.
Figure 4:
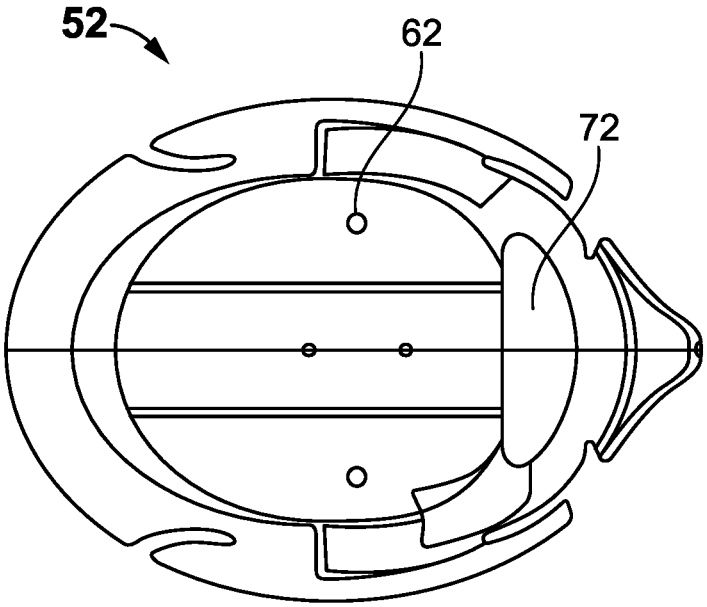
FIG. 4 exemplarily illustrates an underside of a top/outer insert according to one embodiment of the present invention.
Figure 5:
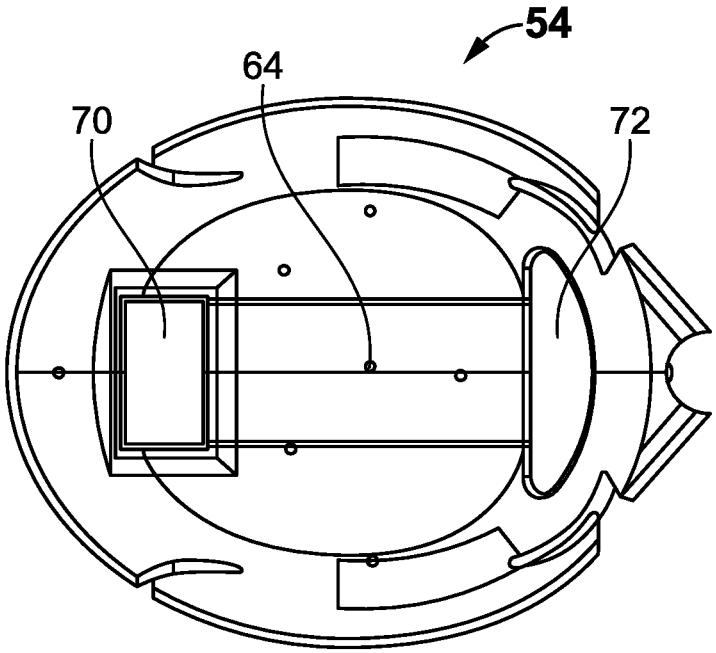
FIG. 5 exemplarily illustrates an underside of a bottom/inner insert according to one embodiment of the present invention FIG. 6 exemplarily illustrates a cut view of the two-part fitness cap according to one embodiment of the present invention.
Figure 6:
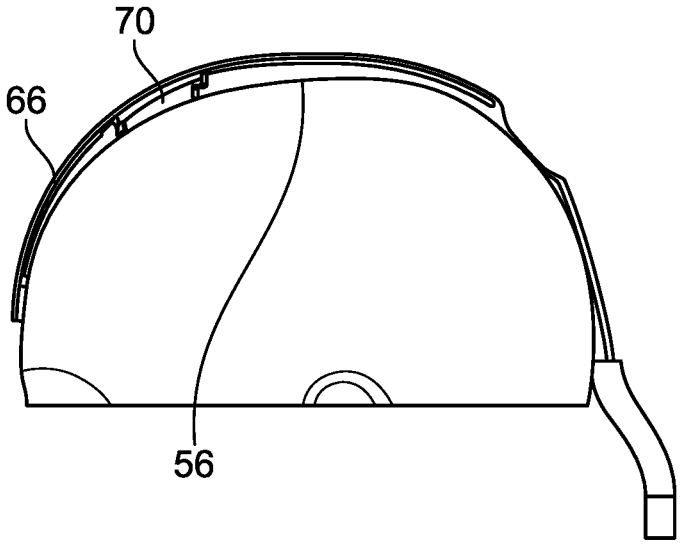

Referring to FIGS. 3-5, various views of a wearable headgear or two-part fitness cap 50 are disclosed. In one embodiment, the wearable headgear 50 comprises has a top or outer insert 52 and a bottom or inner insert 54. The top insert 52 is positioned over the bottom insert 54 and snapped together as shown in FIG. 3. In one embodiment, the top insert 52 and the bottom insert 54 are snapped off on top of each other that forms an inner cavity 56. In one embodiment, the top insert 52 and the bottom insert 54 are placed together to provide an air space gap 66 (as shown in FIG. 6) between them. In one embodiment, the top and bottom insert (52 and 54) are snapped off using some glue to firmly adhere and permanently fix with one another. In one embodiment, the wearable headgear 50 is designed like a baseball cap or a renal cap. The two inserts (52 and 54) together make a shape and shade to fits on a user's head.

In one embodiment, the wearable headgear 50 further comprises an air hose 58 connected at a back portion of the wearable headgear 50 in order to create a positive airflow between the top and bottom inserts (52 and 54). The top insert 52 comprises a first plurality of offsets 62 at its underside. The bottom insert comprises a second plurality of offsets 63 at its outer side. Each offset (62 and 63) has a dimension of about 2 mm to 3 mm. In one embodiment, the offsets (62 and 63) are configured to maintain the air pressure in an air space gap 66 (as shown in FIG. 6). In one embodiment, the bottom insert 54 further comprises a plurality of air jet holes or air holes 64 at its underside. Each air jet hole 64 has a dimension of about 2 mm to 3 mm. In one embodiment, the air jet holes 64 are configured to pass the air via the air hose 58 to cool and dehumidify the user's hair. In one embodiment, the wearable headgear 50 further comprises a back hanging 68. In one embodiment, the back hanging 68 is configured to connect the air jet holes 64. In one embodiment, the air jet holes 64 are essential to join the air space gap 66 and to allow the airflow through the air hose 58 into the pressurized area and down onto the user's head.

In one embodiment, the wearable headgear 50 further comprises a pouch holder 70 configured to hold a desiccant pouch. In one embodiment, the wearable headgear 50 further comprises one or more adjustable openings 72 positioned at its rear portion configured to allow the user's hair to extend through the adjustable opening 72 for preserving opted hairstyle. In one embodiment, the wearable headgear 50 further comprises one or more adjustable openings 72 positioned at its top portion configured to allow the user's hair to extend through the adjustable opening 72 for preserving opted hairstyle.

Referring to FIG. 6, a cut view of the wearable headgear 50 is disclosed. In one embodiment, the top insert 52 and the bottom insert 54 are placed together to provide an air space gap 66 between them. When the air jet holes 64 are pressurized, the air gently passes through the little air space gap 66 and gets onto the user's head. In one embodiment, further the wearable headgear 50 is 3D printed and injection molded. In one embodiment, further the wearable headgear 50 is made of ABS plastic material i.e., flexible yet rigid material. In one embodiment, the wearable headgear 50 further comprises one or more identical slices. In one embodiment, the slices can be bent and are flexible on a user's head to fit the wearable headgear 50 on the user's head. Once the user tightens the wearable headgear 50, the wearable headgear 50 goes further towards the user's head. Further, the slices are allowed to stretch, expand and contract depending on the size of the user's head.

Figure 7:
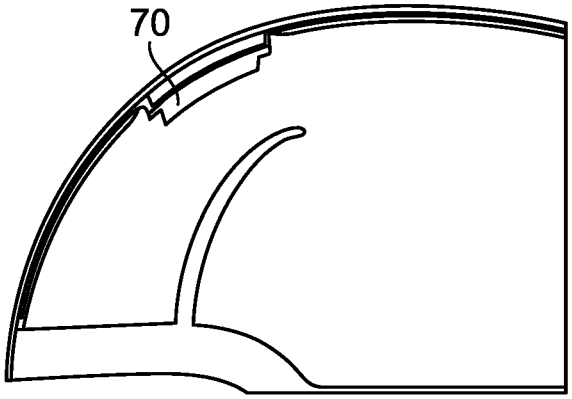
FIG. 7 exemplarily illustrates an enlarged view of a pouch holder according to one embodiment of the present invention.

Referring to FIG. 7, a cut view of a pouch holder 70 is disclosed. In one embodiment, the pouch holder 70 is configured to hold a desiccant pouch. In one embodiment, the desiccant pouch may be a sweat-band configured to absorb water vapor. In one embodiment, In one embodiment, the air hose 58 comprises an air hose opening 60 connected at a back portion of the wearable headgear 50 in order to create a positive airflow between the top and bottom inserts (52 and 54). In one embodiment, the adjustable opening 72 includes a lip on any one side of the top insert or bottom insert and a groove on the opposite side of the top insert 52 or bottom insert 54. In one embodiment, the lip is snugly fixed into the groove configured to provide an air tight seal around the user's hair, thereby maintaining a desired air pressure inside the air space gap 66.

Figure 8:
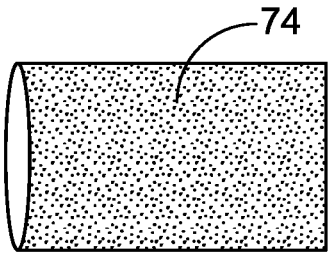
FIG. 8 exemplarily illustrates a material used in the top/outer insert according to one embodiment of the present invention FIG. 9 exemplarily illustrates a material used in the bottom/inner insert according to one embodiment of the present invention.
Figure 9:
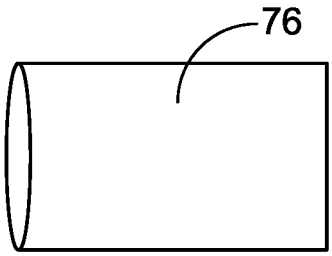

Referring to FIG. 8-9, different materials of the desiccant pouch of the desiccant pouch holder 70 are disclosed. The desiccant pouch may be designed to a standard size or flat rectangular pouch to fit into the pouch holder 70. In one embodiment, the materials are, but not limited to, a mesh material 74 and a Velcro® (hook and loop fastener) material 76. The pouch holder 70 comprises the mesh material 74 on its top portion and the Velcro® material 76 at its bottom portion. In one embodiment, the mesh material 74 allows the water vapor to get vaporized. In one embodiment, the Velcro® material 76 is attached to the top insert 52 on the wearable headgear 50. In one embodiment, the desiccant pouch is placed such that the mesh material 74 is towards the user's head and the Velcro® material 76 is towards the top insert 52.

In one embodiment, the Velcro® material 76 is pushed to open the bottom of the bottom insert 54. In one embodiment, the Velcro® material 76 is positioned on the underside of the top insert 52. In one embodiment, the pouch holder 70 further includes an opening. In one embodiment, the Velcro® material 76 is glued at any one end of the top insert 52. In one embodiment, the Velcro® material 76 uses one or more adhesive strips such as, but not limited to, Velcro® strips, to glue with the top insert 52. In one embodiment, the Velcro® material 76 is held essentially to the top insert 52 by means of a Velcro® or perhaps a snap-fit mechanism where the desiccant pouch can snap fit or slide into the bottom insert 54 through the hole in the underside.

Figure 10:
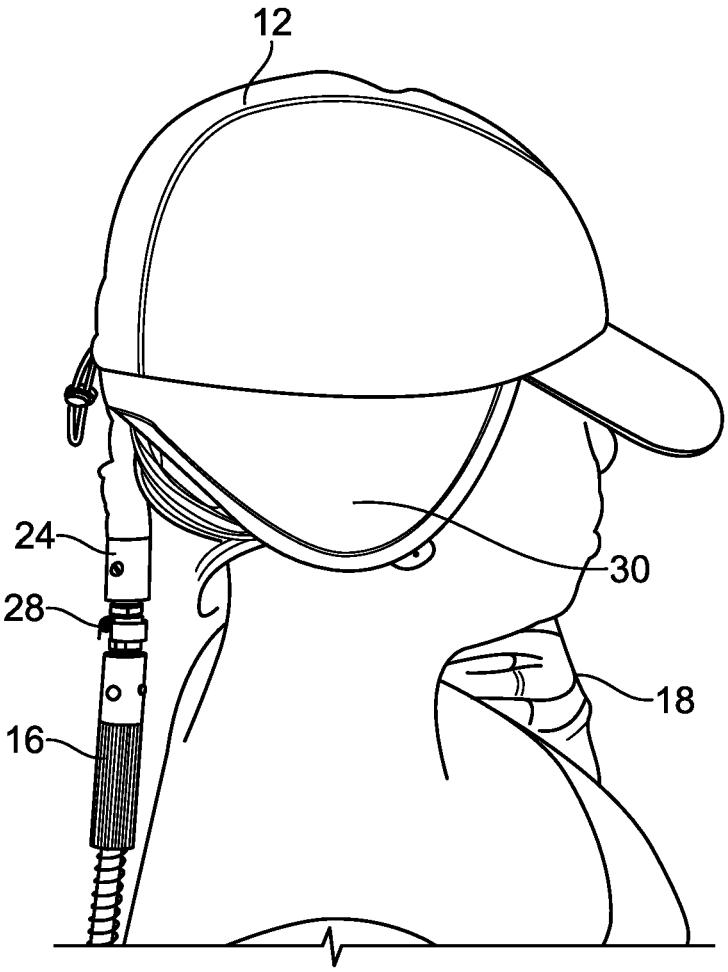
FIG. 10 exemplarily illustrates a side perspective view of a connector securely connected to an open end of a flexible hose of the hair cooling and dehumidification apparatus according to one embodiment of the present invention.
Figure 11:
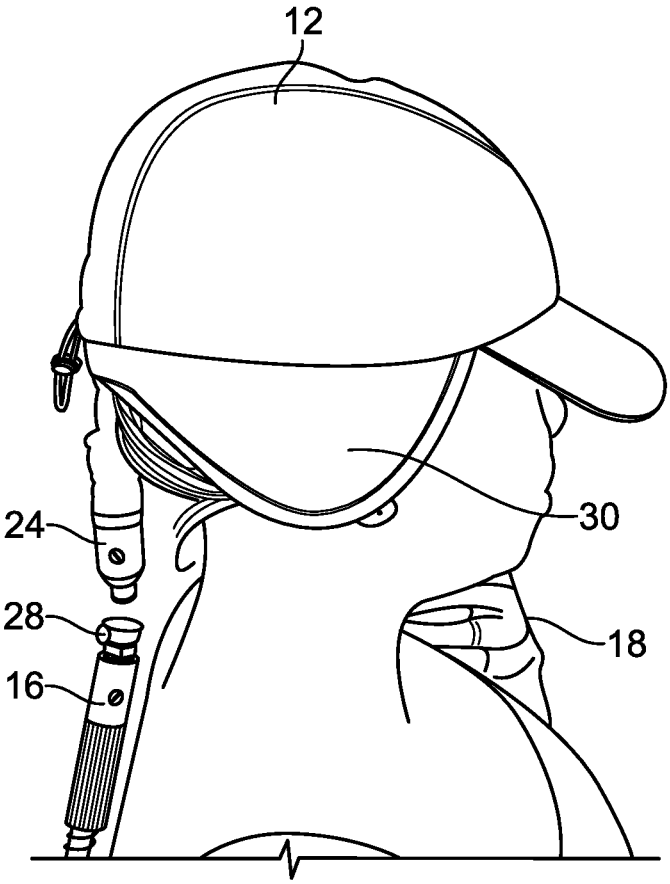
FIG. 11 exemplarily illustrates a side perspective view of a connector quickly disconnected from the open end of the flexible hose of the hair cooling and dehumidification apparatus according to one embodiment of the present invention.

Referring to FIGS. 10-11, the connector 16 is removably connected to the open end of the flexible hose 22 is disclosed. In one embodiment, the connector 16 includes a push-button 28. The push-button 28 is configured to quickly and simply connect and disconnect the flexible hose 22 from the blower unit, thereby reducing the amount of time necessary to connect and disconnect the flexible hose 22 to the blower unit. The push-button 28 allows for a snap-on and snap-off type connection. In one embodiment, the wearable headgear 12 further comprises an extended portion 30 on both sides. The wearable headgear 12 further comprises a moisture absorbing material. The moisture absorbing material is shaped and curved to fit around an edge and ear portions 30 of the wearable headgear 12. The moisture absorbing material is configured to effectively absorb the sweat around the user's brow, ear portions, and the neck portion. In one embodiment, the moisture absorbing material is a sweatband.

In one embodiment, the apparatus 10 further includes a filter. The filter is securely and removably positioned at the blower unit within the portable carrier 14 (shown in FIG. 1). The filter is configured to purify the air for providing freshness to the hair. In one embodiment, the filter is a scented, de-odorizing and air cleaning filter and provided with a desiccant to prevent humid air from entering into the flexible hose 22. In one embodiment, the wearable headgear 12 further comprises a desiccant for drying the user's hair.

Figure 12:
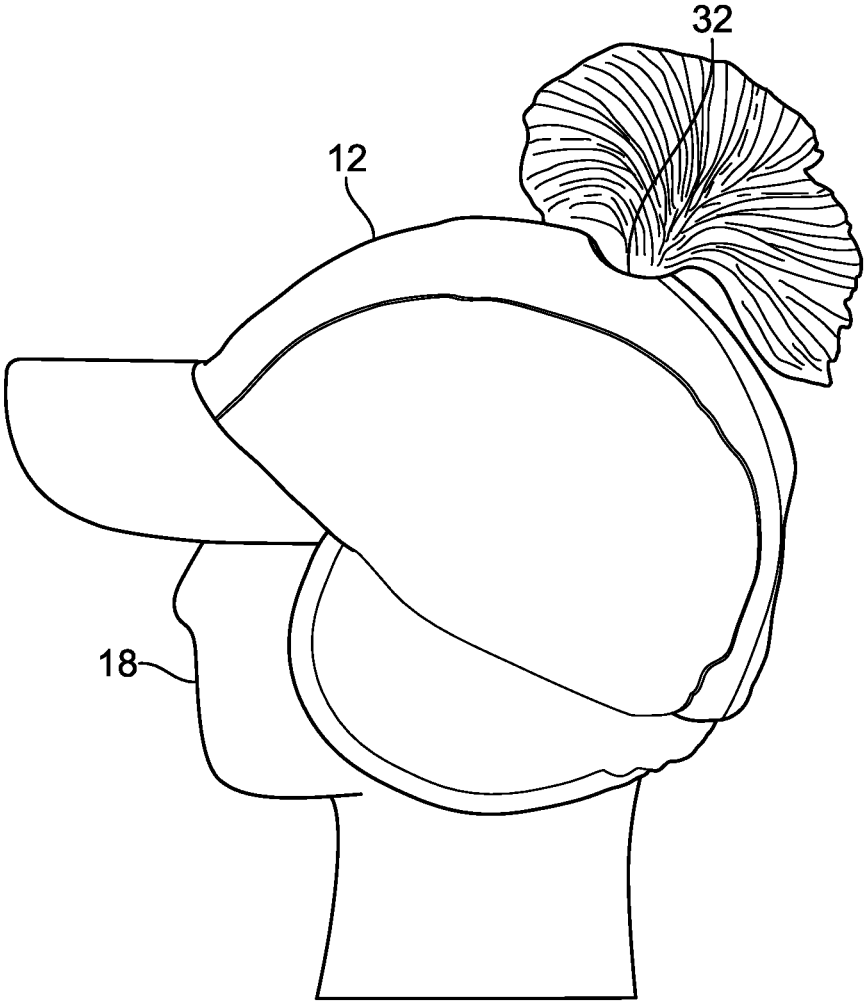
FIG. 12 exemplarily illustrates a wearable headgear worn by a user according to another embodiment of the present invention.
Figure 13:
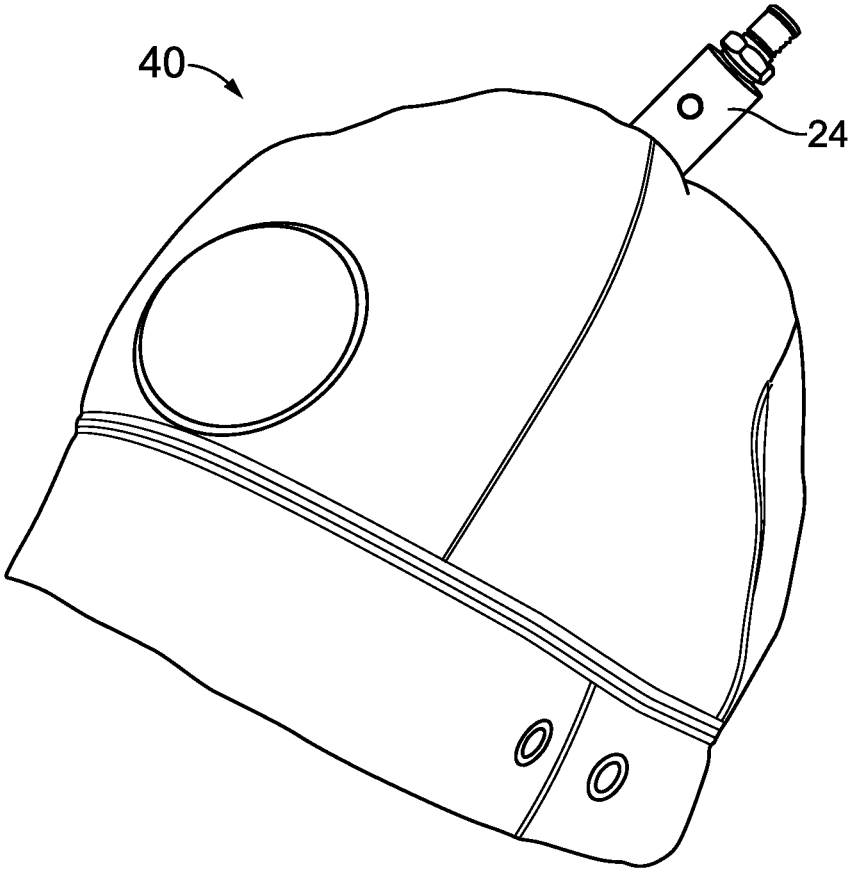
FIG. 13 exemplarily illustrates a cap design for different hair styles according to one embodiment of the present invention.

Referring to FIGS. 12-13, the wearable headgear 12 includes at least one hole 32 on a top portion is disclosed. The hole 32 is provided on, but not limited to, a top portion of the wearable headgear 12. In one embodiment, the wearable headgear 12 is further configured to enable a user to pull the hair from the hole 32 for securing the hair in the form of a ponytail. The user's hairstyle, for example, a ponytail, is maintained firmly in place even the user 18 moving into the wind or engaging in riding, running, or other physical activities which prevent their hair from getting sweaty and moisture. In one embodiment, the wearable headgear 50 includes at least one adjustable opening 72 on top portion as shown in FIG. 13. The adjustable opening 72 is provided on, but not limited to, a top portion of the wearable headgear 50. In one embodiment, the wearable headgear 50 is further configured to enable a user to pull the hair from the adjustable opening 72 for securing the hair in the form of a ponytail. The user's hairstyle, for example, a ponytail, is maintained firmly in place even the user is moving into the wind or engaging in riding, running, or other physical activities which prevent their hair from getting sweaty and moisture. The hole 32 at the top portion of the wearable headgear 12 further allows air for cooling the hair while maintaining comfort and flexibility for the user 18.

Figure 14:
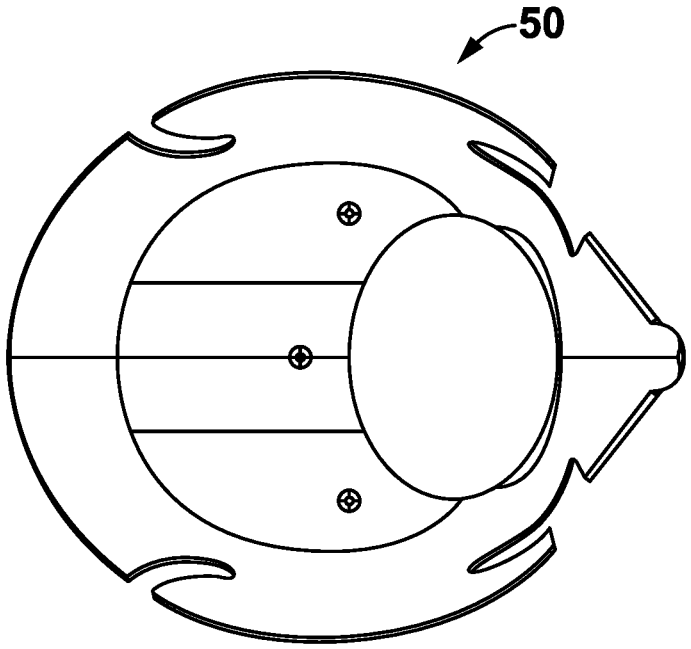
FIG. 14 exemplarily illustrates a wearable headgear according to another embodiment of the present invention.
Figure 15:
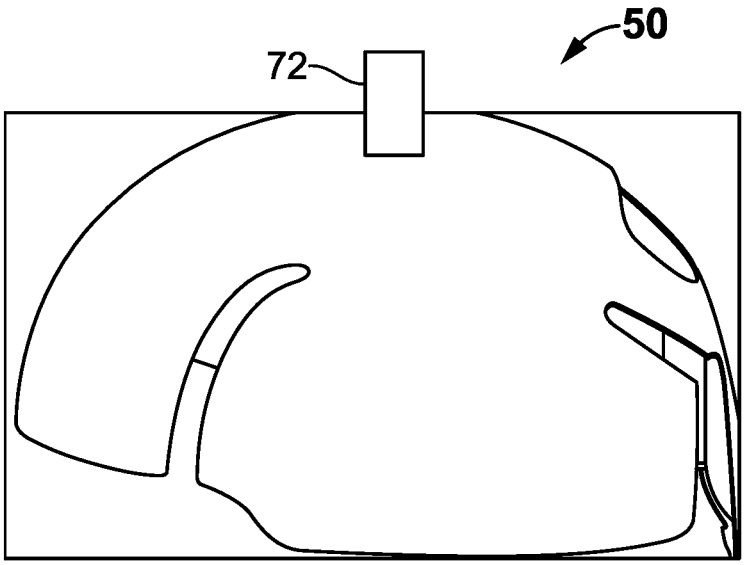
FIG. 15 exemplarily illustrates a cap design for different uses according to one embodiment of the present invention.

Referring to FIGS. 14-15, the wearable headgear 40 used to prevent the hair of the user 18 from getting wet while showering is disclosed. In another embodiment, the wearable headgear 40 is configured to enable a user to use while showering or bathing. The user could simply and quickly wear the wearable headgear 40 while providing comfort to the user 18. In another embodiment, the open end 24 of the flexible hose 22 is pulled out from a top portion of the wearable headgear 40. In one embodiment, the wearable headgear 50 is designed to use for various hair styles such as, but not limited to, ponytails and various bridal hair styles. The wearable headgear 50 is also suitable to use while the user is sleeping and showering. The adjustable opening 72 is increased or personalized as per the user's need. In one embodiment, the wearable headgear 50 for sleeping/showering/bathing includes an air intake opening at the top portion instead from the back portion. Further, the open end 24 is removably connected to the blower unit via the connector 16. The wearable headgear 40 is used to prevent the hair of the user 18 from getting wet or moisture while showering, bathing or swimming.

Figure 16A:
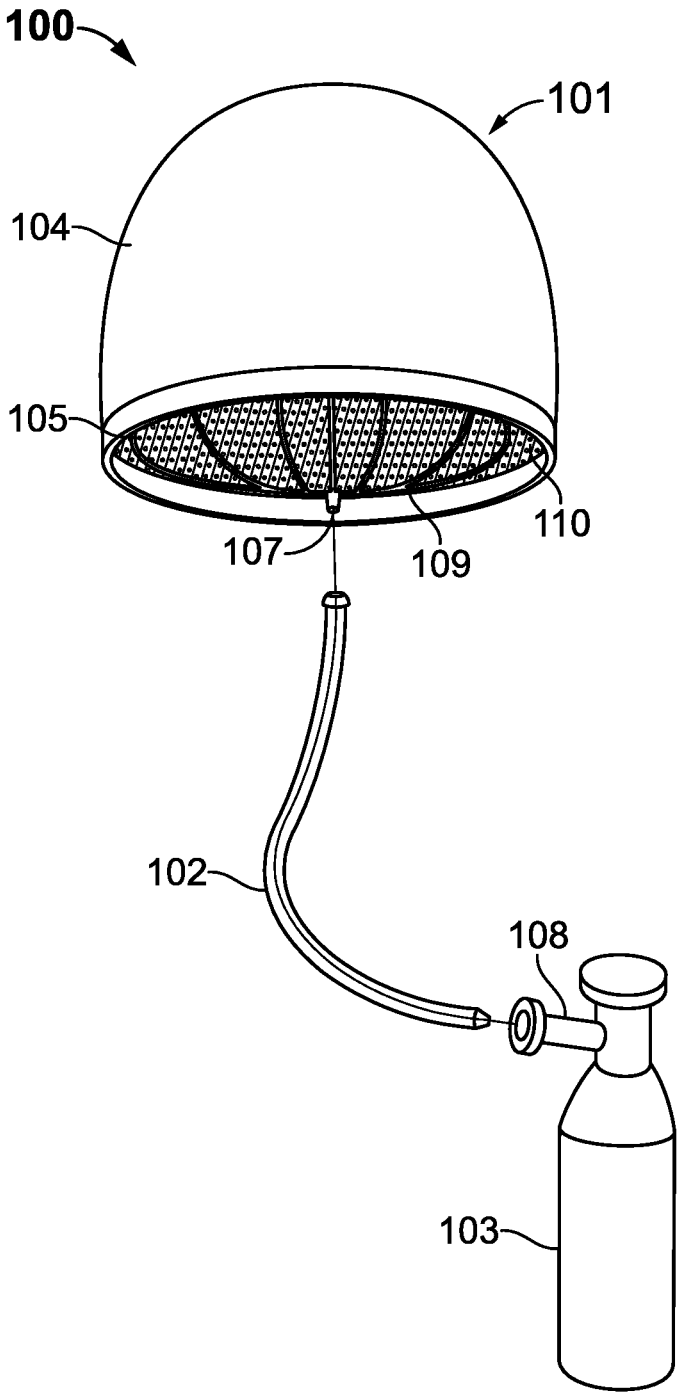
FIG. 16A exemplarily illustrates an exploded view showing components of a hair cooling and dehumidification apparatus.

FIG. 16A exemplarily illustrates an exploded view showing components of a hair cooling and dehumidification apparatus 100. The hair cooling and dehumidification apparatus 100 for cooling and absorbing moisture of hair of a user comprises a wearable headgear 101, a hose 102, and a high-pressure storage tank 103. The wearable headgear 101 comprises an outer layer 104, an insert layer 105, and an inner layer 106, exemplarily illustrated in FIG. 16B. The outer layer 104 comprises a supply port 107. The supply port 107 is in fluid communication with a high-pressure storage tank 103 via a vortex tube 108. In an embodiment, the high-pressure storage tank 103 is mounted on an elastic waistband 401 worn around the waist of the user as exemplarily illustrated in FIG. 19A. The elastic waistband 401 is expandable in nature to be wearable by users of varying hip sizes. In another embodiment, a hip clip is provided to fasten the high-pressure storage tank 103 to the elastic waistband 401. In other embodiments, the high-pressure storage tank 103 is placed in a backpack or a mobility style vest holder. This allows the high-pressure storage tank 103 to be worn or carried around without affecting the user's daily routine. The insert layer 105 is detachably attached to the outer layer 104. The insert layer 105 comprises a network of ducts 109 and a plurality of detachable insert elements 110. The network of ducts 109 is in fluid communication with the supply port 107. The network of ducts 109 receive a cooling gas from the vortex tube 108 and distribute the cooling gas to the hair. The network of ducts 109 is connected and branched throughout the insert layer 105 for air conditioning delivery to the head of the user to help maintain a conducive environment reduced from moisture and heat.

In an embodiment, the high-pressure storage tank 103 stores carbon dioxide ($CO_2$) or air. In case the high-pressure storage tank 103 stores $CO_2$, the $CO_2$ in the high-pressure storage tank 103 exists as a liquid, but when released it turns into a gas. Therefore, by the time the released gas contacts a user's head, the user only feels the cool air flow. Alternately, if compressed air is used, the compressed air is in the gaseous state in the high-pressure storage tank 103, not a liquid like $CO_2$. The detachable insert elements 110 are detachably attached to the insert layer 105 via fasteners. In an embodiment, the fasteners used are, for example, snap fasteners, hook and loop fasteners, etc. Each of the detachable insert elements 110 is spaced apart to accommodate the network of ducts 109 therebetween. Further, each of the detachable insert elements 110 comprise desiccant materials embedded within for absorbing moisture. The inner layer 106 detachably attached to the insert layer 105, is made of a breathable material. Moreover, the inner layer 106 is positioned proximal to the hair of the user to transfer the cooling gas to the hair. In an embodiment, a regulator is provided on the high-pressure storage tank 103 to regulate the flow of cooling gas to the network of ducts 109. This allows a user to regulate the cooling supplied to the hair via the network of ducts 109.

Figure 16B:
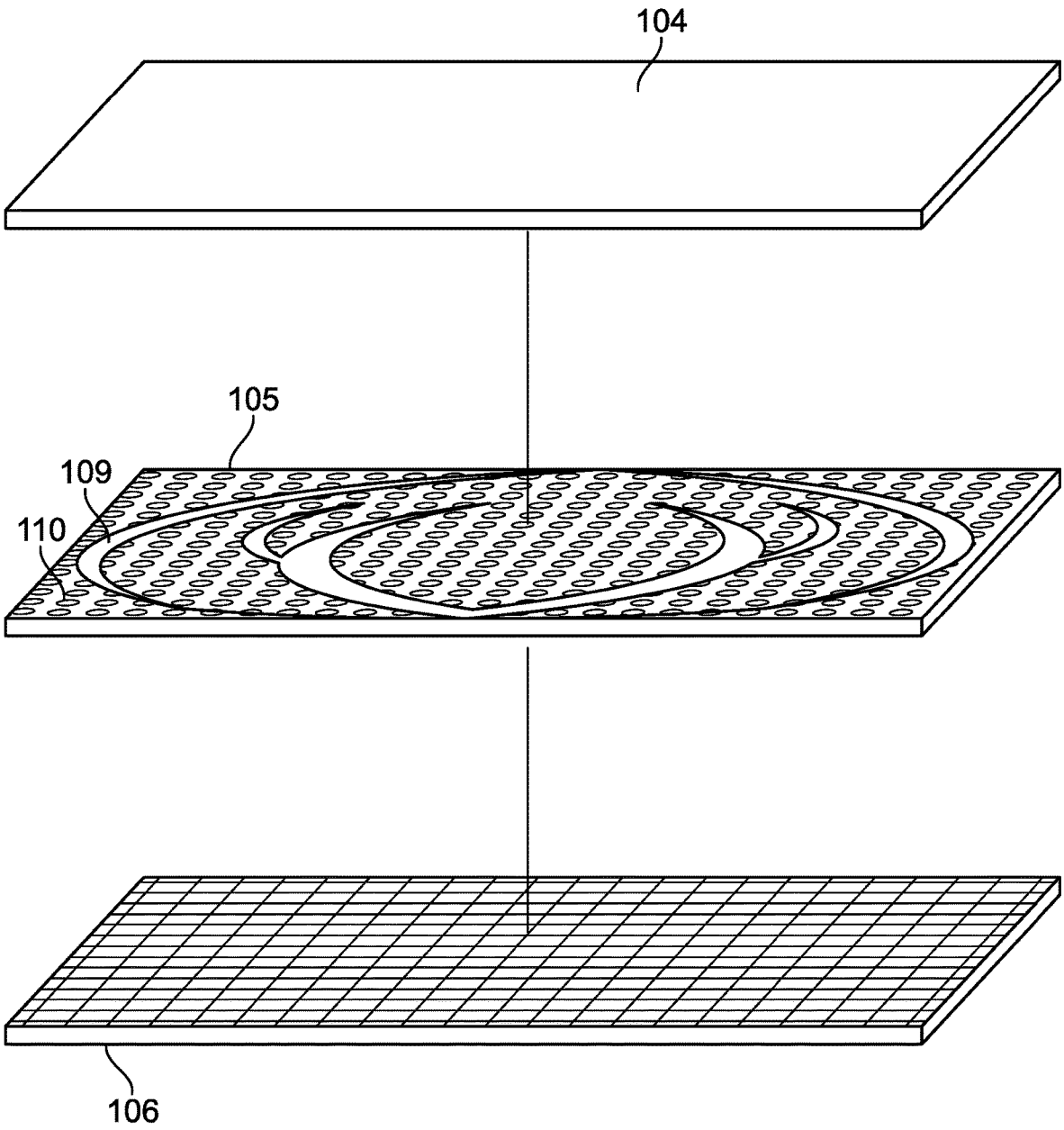
FIG. 16B exemplarily illustrates an exploded view showing layers of a wearable headgear of a hair cooling and dehumidification apparatus.

FIG. 16B exemplarily illustrates an exploded view showing layers of a wearable headgear 101 of a hair cooling and dehumidification apparatus 100 as disclosed in the detailed description of FIG. 16A. The wearable headgear 101, exemplarily illustrated in FIG. 16A, comprises an outer layer 104, an insert layer 105, and an inner layer 106. The inner layer 106 is made of a porous, breathable, absorptive material 113. The outer layer 104 is made of a breathable, absorptive, athletic performance type of material. The outer layer 104 is available in form-fitting or loose-fitting variants depending on the user's hairstyle and preference. The outer layer 104 and the inner layer 106 of the wearable headgear 101 enclose the removable insert layer 105. The insert layer 105 is made of a porous, heat resistant, absorptive material 113, and accommodates the network of ducts 109. The detachable insert elements 110 house the desiccant material 114, for example, silica gel, etc., to absorb moisture from the hair of the user. In an embodiment, heating coils are provided within the detachable insert elements 110 to heat and remove moisture from the detachable insert elements 110.

Figure 17:
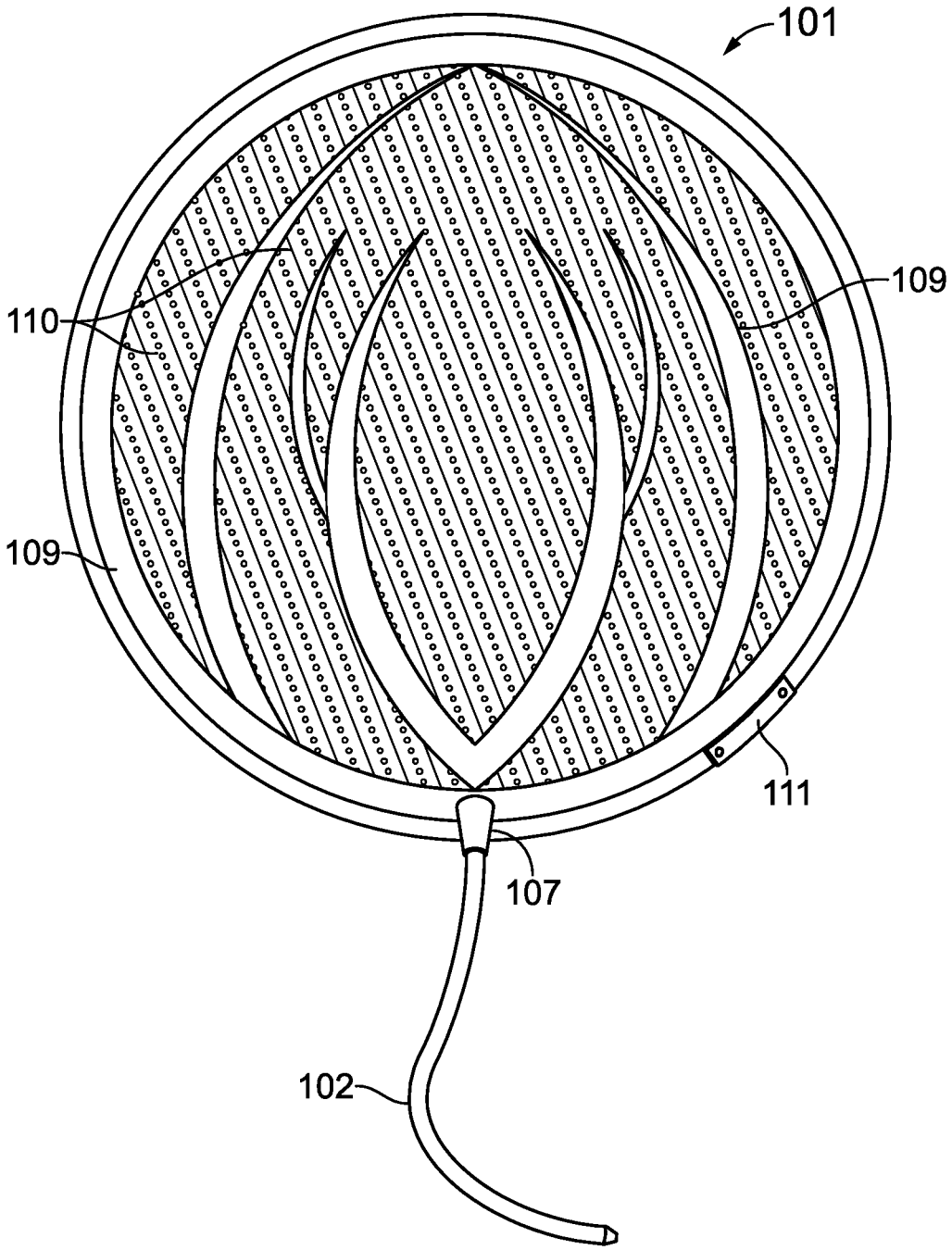
FIG. 17 exemplarily illustrates a bottom plan view of a wearable headgear connected to a hose of a hair cooling and dehumidification apparatus.

FIG. 17 exemplarily illustrates a bottom plan view of a wearable headgear 101 connected to a hose 102 of the hair cooling and dehumidification apparatus 100. In an embodiment, the hose 102 is fastened to the supply port 107 for transferring the cooling gas to the network of ducts 109. In an embodiment, heater elements are provided within the detachable insert elements 110 to remove moisture from the saturated desiccant materials. The desiccant absorbs moisture and changes color when saturated with moisture. In an embodiment, an AC adapter plugged into the charging port 111 of the wearable headgear 101 electrically powers the heater elements. The supply port 107 and the charging port 111 are positioned at the rear of the wearable headgear 101. The network of ducts 109 is in fluid communication with the hose 102 via the supply port 107. The cooling gas received via the hose 102 is distributed throughout the interior of the wearable headgear 101. In an embodiment, the connecting air hose 102 is featured with two male threaded connections at opposing ends of the hose 102. The hose 102 is connected at one end to a source of air flow, for example, a high-pressure storage tank 103, exemplarily illustrated in FIG. 16A.

In an embodiment, the source of the cooling gas can be, for example, a manual air pump, airflow source from a compressor or a $CO_2$/compressed air tank, etc. Further, the airflow source comprises a regulator, which can alter the flow rate delivered to the user's head. In an embodiment, the detachable insert elements 110 fit into the wearable headgear 101. The detachable insert elements 110 are made of a porous material and filled with the desiccant that is used to absorb moisture that builds up between the wearable headgear 101 and the user's hair. In an embodiment, electric heating elements are used to dry out the desiccant after the desiccant has been fully saturated with moisture. The detachable insert elements 110 are removable for the purposes of hand washing and regeneration of the desiccant. The desiccant is reusable and removable from the insert layer 105, exemplarily illustrated in FIG. 16B. In case the desiccant expires its useful life, a new insert layer 105 is used to replace it.

Figure 18A:
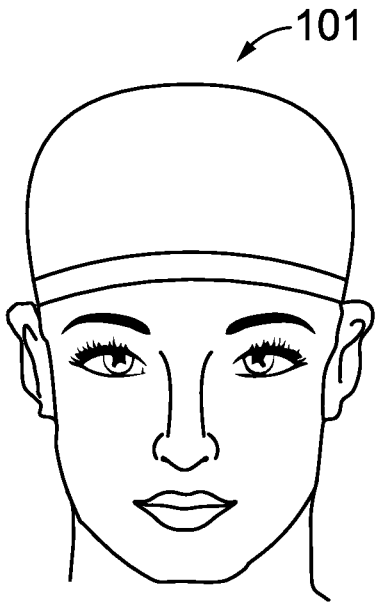
FIG. 18A exemplarily illustrates a front elevation view of a wearable headgear worn by a user.
Figure 18B:
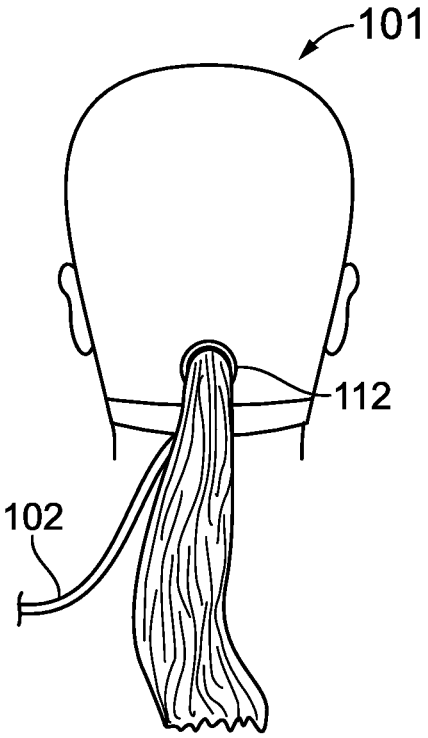
FIG. 18B exemplarily illustrates a rear elevation view of a wearable headgear worn by a user.

FIG. 18A exemplarily illustrates a front elevation view of a wearable headgear 101 worn by a user. FIG. 18B exemplarily illustrates a rear elevation view of a wearable headgear 101 worn by a user. The wearable headgear 101 comprises an adjustable opening 112 positioned at a rear portion of the wearable headgear 101. The hose 102 connects to the wearable headgear 101 to supply cooling gas to the hair of the user as disclosed in the detailed description of FIG. 16A. The adjustable opening 112 is configured to allow the hair of the user to extend through the adjustable opening 112. For a user having a large volume of hair, the adjustable opening 112 is enlarged to allow the hair to extend through the adjustable opening 112.

Figure 19A:
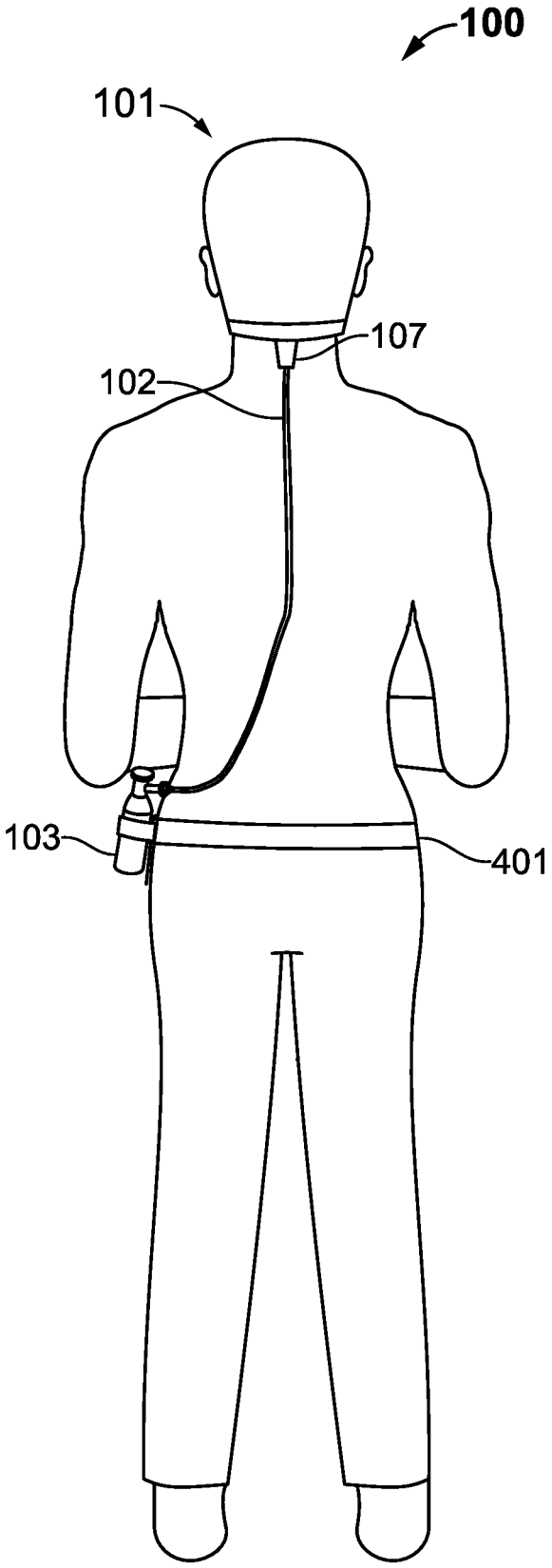
FIG. 19A exemplarily illustrates a rear elevation view of a hair cooling and dehumidification apparatus worn by a user.

FIG. 19A exemplarily illustrates a rear elevation view of a hair cooling and dehumidification apparatus 100 worn by a user. The wearable headgear 101 is worn on the head of the user. The hose 102 is connected to the wearable headgear 101 via the supply port 107 at a first end. A second end of the hose 102 is fastened to the high-pressure storage tank 103. The high-pressure storage tank 103 is mounted on an elastic waistband 401 worn around the waist of the user. In an embodiment, the elastic waistband 401 is expandable in nature to be wearable by users of varying hip sizes. In another embodiment, a hip clip is provided to fasten the high-pressure storage tank 103 to the elastic waistband 401. In other embodiments, the high-pressure storage tank 103 is placed in a backpack or a mobility style vest holder. This allows the high-pressure storage tank 103 to be worn or carried around without affecting the user's daily routine.

Figure 19B:
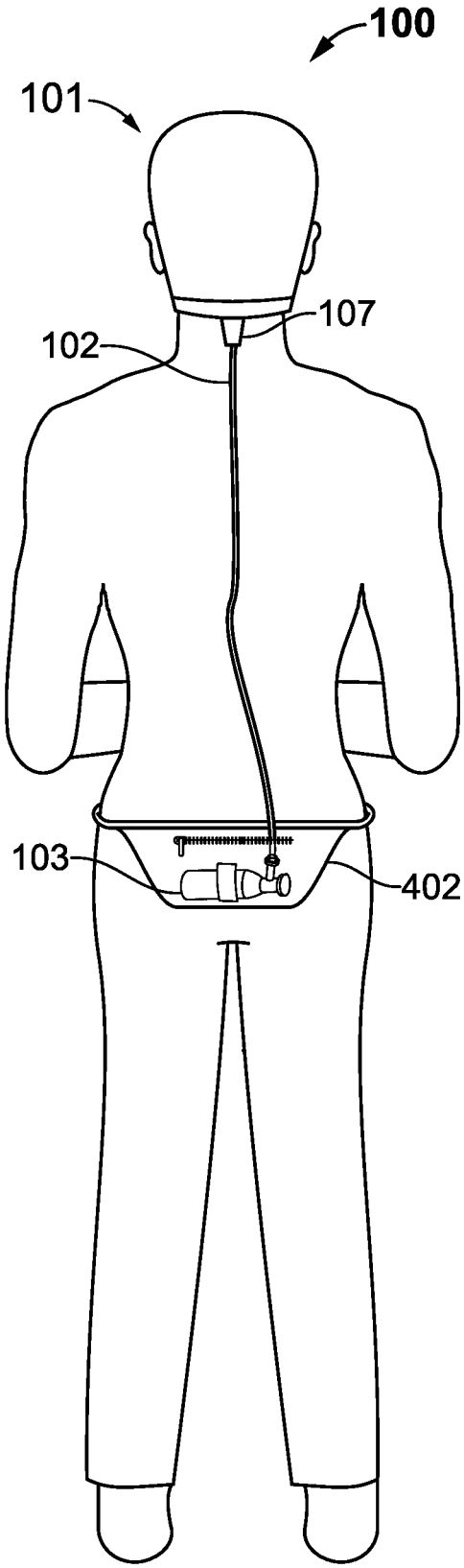
FIG. 19B exemplarily illustrates a rear elevation view of a hair cooling and dehumidification apparatus worn by a user.

FIG. 19B exemplarily illustrates a rear elevation view of a hair cooling and dehumidification apparatus 100 worn by a user. The wearable headgear 101 is worn on the head of the user. The hose 102 is connected to the wearable headgear 101 via the supply port 107 at a first end. A second end of the hose 102 is fastened to the high-pressure storage tank 103. The high-pressure storage tank 103 is housed in a pouch 402 worn around the waist of the user. Any individual who wishes to keep their head from sweating uses the hair cooling and dehumidification apparatus 100. The primary use of the hair cooling and dehumidification apparatus 100 is for women who have natural hair that has been straightened. Alternately, women who have hairstyles that are prone to spoiling due to perspiration created while in a hot, humid environment or while participating in an activity use variant of the hair cooling and dehumidification apparatus 100. In an embodiment, a loose-fitting wearable headgear 101 is used if the individual is participating in an activity that involves aggressive body movement. Moreover, the wearable headgear 101 and insert attachments are looser for women who wish to keep their hair from moisture infiltration. This variant of the wearable headgear has an adjustable opening 112 in the rear portion of the wearable headgear 101, as exemplarily illustrated in FIG. 18B, if a woman wants to allow her ponytail to hang out from the adjustable opening 112 in the wearable headgear 101.

The advantages of the present invention include: the apparatus 100 effectively absorbs moisture or perspiration from the hair to preserve the opted hairstyle of an individual without affecting the user's lifestyle. The apparatus 100 provides freshness to the user's hair while even the user 108 moving into the wind or engaging in riding, running, or other physical activities and prevents the hair from getting sweaty and moisture. The apparatus 100 is simple, lightweight, versatile, comfortable to wear, and compact. The apparatus 100 could be simply used during running or actively engaging in other physical activities. In one embodiment, the shape and size of the wearable headgear 102 could be varied based on the user's requirement.

Figure 20:
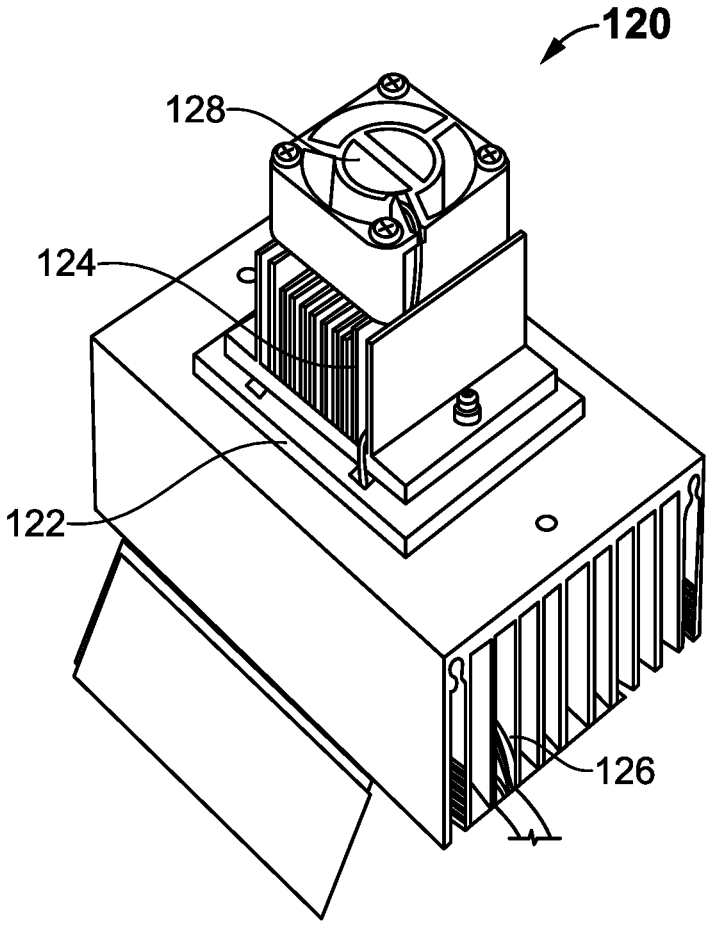
FIG. 20 exemplarily illustrates a perspective view of a thermo-electric cooling system according to one embodiment of the present invention.

Referring to FIG. 20, a thermo-electric cooling system 120 is disclosed. In one embodiment, the thermo-electric cooling system 120 comprises a thermoelectric cooler or thermoelectric cooling plate 122. The thermoelectric cooling plate 122 has a cold side and a hot side. In one embodiment, thermo-electric cooling system 120 further comprises a small heat sink 124 and a large heat sink 126. The small heat sink 124 is connected to the cold side of the thermoelectric cooling plate 122. The large heat sink 126 is connected to the hot side of the thermoelectric cooling plate 122. In one embodiment, the large heat sink 126 is connected to the bottom of the hot side of the thermoelectric cooling plate 122, whereas the small heat sink 124 is connected to the cold side on the other side.

In one embodiment, the thermoelectric cooling system 120 further comprises a blower unit 128. In one embodiment, the blower unit 128 is attached above the small heat sink 124 which is connected to the cold side of the thermoelectric cooling plate, to circulate the ambient air within the housing over the cold heat sink, to cool the incoming air circulating within the housing, thereby providing cooling and dehumidification of user's hair. In one embodiment, the blower unit 128 is configured to circulate the ambient air inside the small heat sink 124 to remove an excess heat generated by the thermoelectric cooling plate 122 and the excess heat is transferred to the large heat sink 126 to exhaust the excess heat, thereby providing cooling to the user's hair and protecting from moisture or perspiration for preserving an opted hairstyle of the user. In one embodiment, the blower unit 128 generates AC when blowing ambient air above the small heat sink 124. In one embodiment, the blower unit 128 is a fan.

Figure 21:
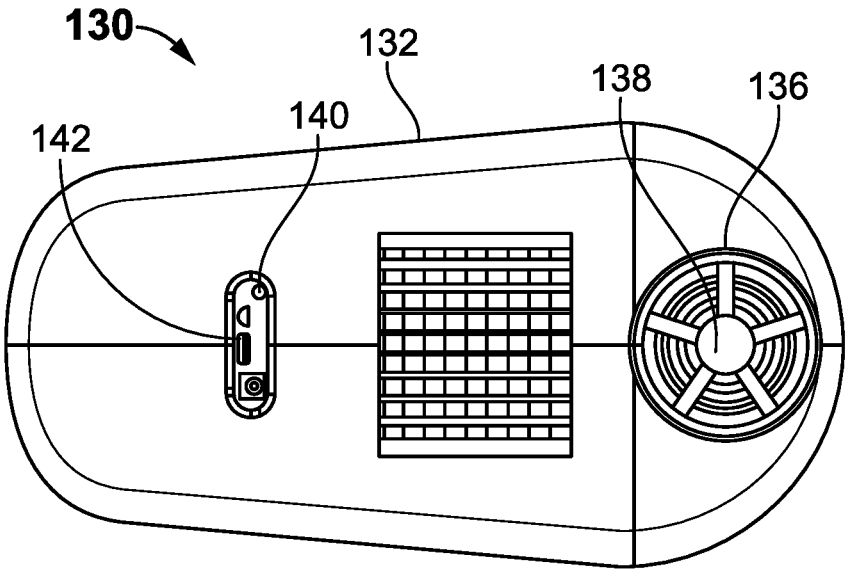
FIG. 21 exemplarily illustrates an outer view of an outer cover of the thermo-electric cooling system according to one embodiment of the present invention.
Figure 23:
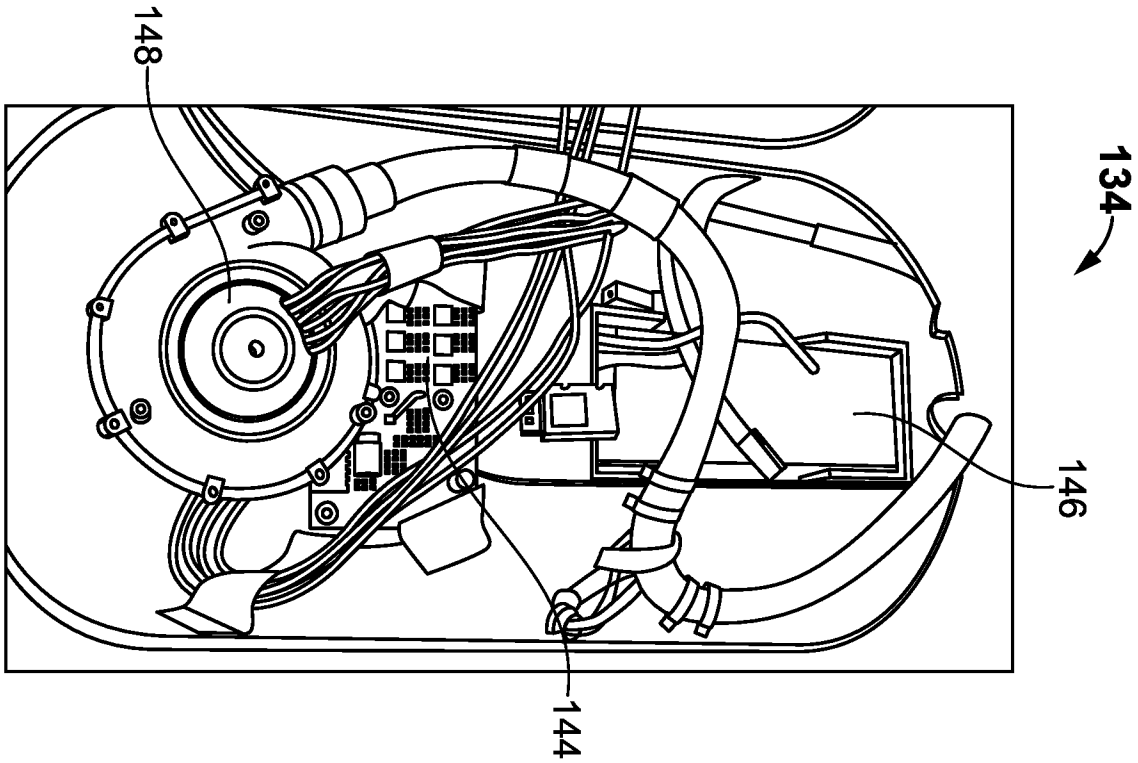
FIG. 23 exemplarily illustrates a perspective view of inner cover mechanicals of the thermo-electric cooling system according to one embodiment of the present invention.

Referring to FIG. 21, a perspective view of housing 130 of the thermo-electric cooling system 120 are disclosed. The housing 130 is a two-part enclosure configured to completely enclose the thermoelectric cooling system 120 and a plurality of internal components. In one embodiment, the housing 130 comprises an outer cover 132 and an inner cover 134 (as shown in FIG. 23). The outer cover 132 and the inner cover 134 are snapped together to form the housing 130. In one embodiment, the large heat sink 126 of the thermoelectric cooling system 120 stays external to the housing 130 at the outer cover 132 as it is an exhaust for the heat generated by the thermoelectric cooling plate 122. In one embodiment, the small heat sink 124 gives AC to the inner side of the housing 130. In one embodiment, the housing 130 further comprises a first circuit board. The first circuit board attached to the outer cover 132. In one embodiment, the circuit board has a plurality of operational components such as, but not limited to, one or more indicators 140 and at least one USB port 142.

Figure 22:
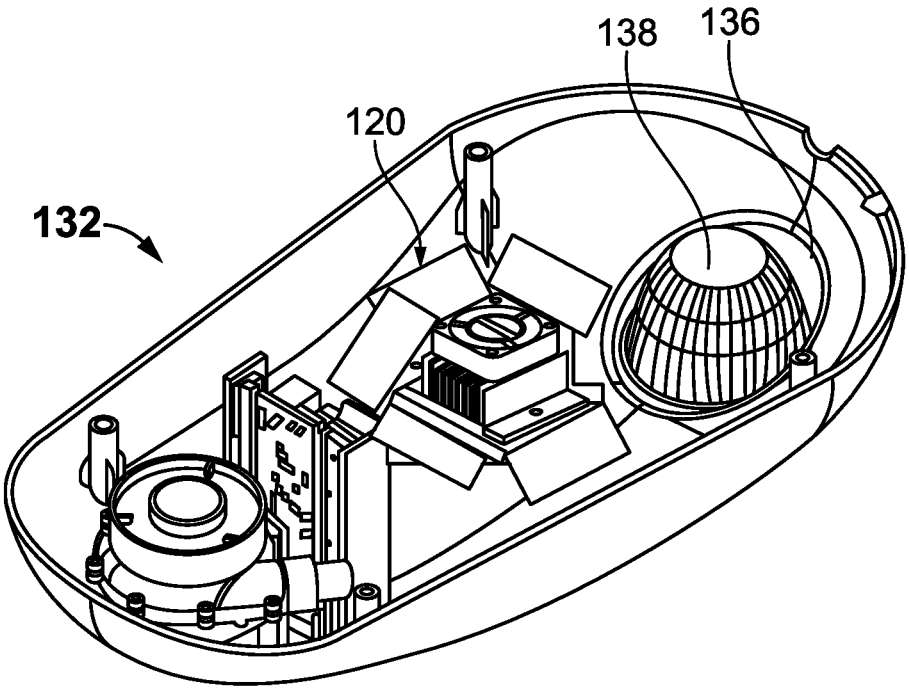
FIG. 22 exemplarily illustrates an inside view of the outer cover of the thermo-electric cooling system according to one embodiment of the present invention.

Referring to FIGS. 22-23, an internal view of the outer cover 132 and its internal mechanicals are disclosed, respectively. In one embodiment, the outer cover 132 comprises a vent 136 configured to receive a TR black fan or exhaust fan 138. The thermo-electric cooling system 120 is attached to the outer cover 132. The blower unit 128 blows air on the cold side which creates a cold air or air-conditioned air. The air-conditioned air is sucked via a pump 148 and moves to the user's head via the air hose 58. The air-conditioned air further increases the cooling effect of the elements in the small heat sink 124. The exhaust fan 138 pulls the hot air away from the housing 130. In one embodiment, the air passing across the small heat sink 124 cools the ambient air and the cold air is circulated by the blower unit 128 which is then pushed in a positive direction through the air hose 58 up into the wearable headgear 50. Further, the heat escapes out from the large heat sink 126 through the exhaust fan 138 to outside side of the housing 130.

In one embodiment, the housing 130 further comprises a second circuit board or addition circuit board 144 built with a plurality of operational components configured to control the air flow. In one embodiment, the housing 130 further comprises a DC adapter 146 to supply power to the internal components. In one embodiment, the thermal electric cooling system 120, blower unit 128, and the exhaust fan 138 are connected to at least one or more batteries which are housed within the outer cover 132. In one embodiment, the battery plugs into the second circuit board 144. In one embodiment, the second circuit board 144 includes a microprocessor/controller configured to run the air pump 148. The air pump 148 works based on the circuit board instructions.

Figure 24:
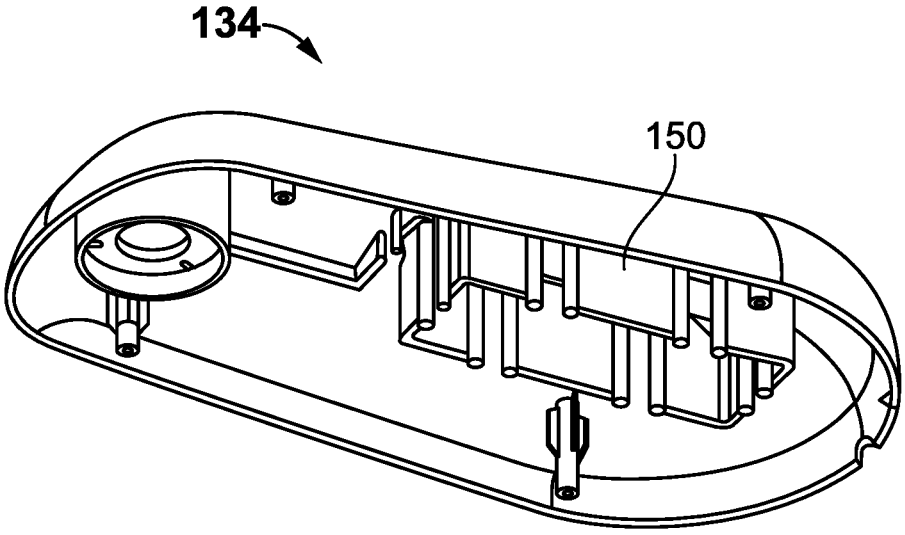
FIG. 24 exemplarily illustrates an inside view of an inner cover of the thermo-electric cooling system according to one embodiment of the present invention.

Referring to FIG. 24, a perspective view of the inner cover 134 of the housing 130 is disclosed. In one embodiment, the inner cover 134 includes a plurality of sections 150 configured to snugly enclose a plurality of internal components positioned inside the outer cover 132.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A hair cooling and dehumidification apparatus for cooling and absorbing moisture from a user's hair, comprising:

a wearable headgear or two-part fitness cap having an inner cavity for receiving a portion of the user's head, wherein the wearable headgear comprising:

a top or outer insert having a first plurality of offsets at its underside and a bottom or inner insert having a second plurality of offsets at its outer side, wherein the top and bottom inserts are snapped together to provide an air space gap for circulating air within the interior cavity via the first and second plurality of offsets;

a pouch holder holding a desiccant pouch, wherein the desiccant pouch includes a mesh material at its top side configured to allow water vapour to get absorbed, and a hook and loop fastener material at its bottom side configured to attach to the top insert, and a housing enclosing a thermo-electric cooling system, wherein the thermo-electric cooling system comprising:

a thermoelectric cooler or thermoelectric cooling plate having a top cold side and a bottom hot side;

a small heat sink attached to the top cold side of the thermoelectric cooler;

a large heat sink attached to the bottom hot side of the thermoelectric cooler, and a blower unit attached to the small heat sink configured to circulate the ambient air within the housing over the cold side generated by the thermoelectric cooling plate and the excess heat is transferred to the large heat sink to exhaust the excess heat, thereby providing cooling to the user's hair and protecting from moisture or perspiration for preserving an opted hairstyle of the user.

2. The apparatus of claim 1, wherein the first and second plurality of offsets are configured to maintain the air space gap between the top insert and the bottom insert.

3. The apparatus of claim 1, further comprises an air hose is connected to a back portion of the wearable headgear configured to allow air flow into the air space gap, thereby circulating the air within the interior cavity via the first and second plurality of offsets for cooling and dehumidification of the user's hair.

4. The apparatus of claim 1, wherein the bottom insert comprises a plurality of air jet holes configured to pass the air via the air hose to cool and dehumidify the user's hair.

5. The apparatus of claim 1, further comprises one or more adjustable openings positioned at a rear portion or top portion of the wearable headgear configured to allow the user's hair to extend through the adjustable opening for preserving opted hairstyle.

6. The apparatus of claim 5, wherein the adjustable opening includes a lip on any one side of the top insert or bottom insert and a groove on the opposite side of the top insert or bottom insert.

7. The apparatus of claim 6, wherein the lip snugly fixes into the groove configured to provide an air tight seal around the user's hair, thereby maintaining a desired air pressure inside the wearable headgear.

8. The apparatus of claim 1, wherein the housing comprises an outer cover having an exhaust fan at its outside, wherein the exhaust fan is attached to bottom side of the large heat sink configured to exhaust the excess heat generated by the thermoelectric cooling plate.

9. The apparatus of claim 1, wherein the housing further comprises an inner cover having a plurality of sections configured to snugly enclose a plurality of internal components positioned inside the outer cover.

10. The apparatus of claim 1, wherein the small heat sink provides air conditioning inside the housing.

11. The apparatus of claim 1, wherein the blower unit is a fan powered by at least one or more batteries.

12. A hair cooling and dehumidification apparatus for cooling and absorbing moisture of hair of a user, comprising:

a wearable headgear having an inner cavity for receiving a portion of the user's head, wherein the wearable headgear comprising:

a top or outer insert having a first plurality of offsets and a bottom or inner insert having a second plurality of offsets, wherein the top insert and the bottom insert are snapped together to provide an air space gap for circulating air within the interior cavity via the first plurality of offsets and second plurality of offsets;

a pouch holder disposed with a desiccant pouch, wherein the desiccant pouch includes a mesh material at its top side configured to allow water vapour to get absorbed, and a hook and loop fastener material at its bottom side configured to attach to the top insert;

an air hose is connected to a back portion of the wearable headgear configured to allow air flow into the air space gap, thereby circulating the air within the interior cavity via the first and second plurality of offsets for cooling and dehumidification of the user's hair;

one or more adjustable openings positioned at a rear portion or top portion of the wearable headgear configured to allow the user's hair to extend through the adjustable opening for preserving opted hairstyle, and a housing enclosing a thermo-electric cooling system, wherein the thermo-electric cooling system comprising:

a thermoelectric cooler or thermoelectric cooling plate having a top cold side and a bottom hot side;

a small heat sink attached to the top cold side of the thermoelectric cooler;

a large heat sink attached to the bottom hot side of the thermoelectric cooler, and a blower unit attached to the small heat sink configured to circulate the ambient air within the housing over the cold side generated by the thermoelectric cooling plate and the excess heat is transferred to the large heat sink to exhaust the excess heat, thereby providing cooling to the user's hair and protecting from moisture or perspiration for preserving an opted hairstyle of the user.

13. The apparatus of claim 12, wherein the first plurality of offsets and the second plurality of offsets are configured to maintain the air space gap between the top insert and the bottom insert.

14. The apparatus of claim 12, wherein the adjustable opening includes a lip on any one side of the top insert or bottom insert and a groove on the opposite side of the top insert or bottom insert.

15. The apparatus of claim 14, wherein the lip snugly fixes into the groove configured to provide an air tight seal around the user's hair, thereby maintaining a desired air pressure inside the wearable headgear.

16. The apparatus of claim 12, wherein the housing comprises an outer cover having an exhaust fan at its outside, wherein the exhaust fan is attached to bottom side of the large heat sink configured to exhaust the excess heat generated by the thermoelectric cooling plate.

17. The apparatus of claim 12, wherein the housing further comprises an inner cover having a plurality of sections configured to snugly enclose a plurality of internal components positioned inside the outer cover.

18. The apparatus of claim 12, wherein the small heat sink provides air conditioning inside the housing.

19. The apparatus of claim 12, wherein the blower unit is a fan powered by at least one or more batteries.

* * * * *